US010533263B2

(12) United States Patent
Matsuda

(10) Patent No.: US 10,533,263 B2
(45) Date of Patent: Jan. 14, 2020

(54) METHOD FOR CONTINUOUS ELECTROLYTIC ETCHING OF GRAIN ORIENTED ELECTRICAL STEEL STRIP AND APPARATUS FOR CONTINUOUS ELECTROLYTIC ETCHING OF GRAIN ORIENTED ELECTRICAL STEEL STRIP

(71) Applicant: JFE STEEL CORPORATION, Tokyo (JP)

(72) Inventor: Kenji Matsuda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 204 days.

(21) Appl. No.: 15/550,266

(22) PCT Filed: Feb. 9, 2016

(86) PCT No.: PCT/JP2016/053755
§ 371 (c)(1),
(2) Date: Aug. 10, 2017

(87) PCT Pub. No.: WO2016/140022
PCT Pub. Date: Sep. 9, 2016

(65) Prior Publication Data

US 2018/0030612 A1 Feb. 1, 2018

(30) Foreign Application Priority Data

Mar. 4, 2015 (JP) ..... 2015-042745

(51) Int. Cl.
*C25F 3/06* (2006.01)
*H01F 1/16* (2006.01)
(Continued)

(52) U.S. Cl.
CPC ..... *C25F 3/06* (2013.01); *C21D 8/12* (2013.01); *C21D 8/1233* (2013.01);
(Continued)

(58) Field of Classification Search
CPC ..... C25F 3/06; C25F 3/14
See application file for complete search history.

(56) References Cited

U.S. PATENT DOCUMENTS 6,120,671 A 9/2000 Karner et al.
2007/0227632 A1 10/2007 Schnetz et al.
(Continued)

FOREIGN PATENT DOCUMENTS

CN 1918328 A 2/2007
CN 104284994 A 1/2015
(Continued)

OTHER PUBLICATIONS

Translation of JP Office Action dated Aug. 8, 2017 for JP No. 2015-042745 (Year: 2017).*
(Continued)

*Primary Examiner* — Nicholas A Smith
(74) *Attorney, Agent, or Firm* — Oliff PLC

(57) ABSTRACT

Method for continuous electrolytic etching of a grain oriented electrical steel strip includes: forming an etch mask on a surface of a grain oriented electrical steel strip cold-rolled to final thickness with a linear exposed portion exposed from the etch mask; centering the grain oriented electrical steel strip with a position sensor and centering apparatus, which are placed immediately upstream of an electrolytic etching apparatus; and performing an electrolytic etching process in which electrolytic etching is performed in the electrolytic etching apparatus to form a linear groove on the surface of the grain oriented electrical steel strip by passing electric current between a conductor roll and electrode placed in an electrolytic bath while the grain oriented electrical steel strip is brought into contact with the conductor roll, the grain
(Continued)

oriented electrical steel strip is immersed in the electrolytic bath and the grain oriented electrical steel strip is facing the electrode.

3 Claims, 3 Drawing Sheets

(51) Int. Cl.

| | |
|---|---|
| ***C21D 8/12*** | (2006.01) |
| ***C25F 3/14*** | (2006.01) |
| ***C22C 38/00*** | (2006.01) |
| ***C22C 38/02*** | (2006.01) |
| ***H01F 1/18*** | (2006.01) |

(52) U.S. Cl.
CPC ..... *C21D 8/1283* (2013.01); *C22C 38/00* (2013.01); *C22C 38/02* (2013.01); *C25F 3/14* (2013.01); *H01F 1/16* (2013.01); *H01F 1/18* (2013.01); *C21D 2201/05* (2013.01)

(56) References Cited

U.S. PATENT DOCUMENTS

| | | | | |
|---|---|---|---|---|
| 2010/0051475 | A1* | 3/2010 | Eto ..... | B23H 3/04 205/674 |
| 2015/0111004 | A1 | 4/2015 | Senda et al. | |
| 2016/0030968 | A1 | 2/2016 | Kobayashi et al. | |

FOREIGN PATENT DOCUMENTS

| | | | |
|---|---|---|---|
| EP | 1342818 | A2 | 9/2003 |
| JP | S58-34846 | U | 3/1983 |
| JP | S61-021487 | Y2 | 6/1986 |
| JP | S63-153222 | A | 6/1988 |
| JP | H03-13599 | A | 1/1991 |
| JP | H05-320999 | A | 12/1993 |
| JP | H06-109900 | A | 4/1994 |
| JP | H07-188755 | A | 7/1995 |
| JP | H08-006140 | B2 | 1/1996 |
| JP | H08-269563 | A | 10/1996 |
| JP | H09-3698 | A | 1/1997 |
| JP | H10-130898 | A | 5/1998 |
| JP | H10-204698 | A | 8/1998 |
| JP | H11-199936 | A | 7/1999 |
| JP | 2002-266100 | A | 9/2002 |
| JP | 2014-171998 | A | 9/2014 |
| JP | 2014-171999 | A | 9/2014 |
| RU | 2205254 | C2 | 5/2003 |

OTHER PUBLICATIONS

Sep. 28, 2018 Extended European Search Report issued in European Patent Application No. 16758717.9.

Aug. 8, 2017 Office Action issued in Japanese Patent Application No. 2015-042745.

Jul. 13, 2018 Office Action issued in Russian Patent Application No. 2017134010.

Jul. 31, 2018 Chinese Office Action issued in Chinese Patent Application No. 201680011249.X.

Oct. 12, 2018 Office Action issued in Korean Patent Application No. 10-2017-7027732.

"Rust Prevention and Surface Treatment". p. 276-279, Jan. 5, 2000.

Apr. 12, 2016 International Search Report issued in International Patent Application No. PCT/JP2016/053755.

* cited by examiner

METHOD FOR CONTINUOUS ELECTROLYTIC ETCHING OF GRAIN ORIENTED ELECTRICAL STEEL STRIP AND APPARATUS FOR CONTINUOUS ELECTROLYTIC ETCHING OF GRAIN ORIENTED ELECTRICAL STEEL STRIP

FIELD

The present invention relates to a method for continuous electrolytic etching of a grain oriented electrical steel strip and an apparatus for continuous electrolytic etching of a grain oriented electrical steel strip.

BACKGROUND

A technology has conventionally been disclosed which improves the properties of a grain oriented electrical steel strip (hereinafter simply referred to as "steel strip" as appropriate) by printing an etch resist on a surface of the steel strip with an electrically insulating ink, and subsequently forming an etch pattern by an electrolytic etching process on the surface of the steel strip where the etch resist has been printed (refer to Patent Literature 1). An electrolytic etching process that is excellent in the stability of an etched state of a product has been requested to industrially perform such a technology for improving the properties of a steel strip using such an electrolytic etching process.

Patent Literature 2 proposes a method for obtaining the capability of uniform etching in a width direction of a steel strip by covering both sides of the steel strip and restraining the flow of an electrolyte in the width direction of the steel strip to obtain a uniform cross-sectional shape of a groove in the width direction.

CITATION LIST

Patent Literature

Patent Literature 1: Japanese Examined Patent Application Publication No. H8-6140

Patent Literature 2: Japanese Patent Application Laid-open Patent Publication No. H10-204698

SUMMARY

Technical Problem

There is still room for improvement in increasing the stability of an etched state. If, for example, the width of an electrode is too large as compared to the width of a steel strip, the amount of electrolytic etching at an edge of the steel strip becomes larger than the amount of electrolytic etching at any other portions such as the center of the steel strip due to a current flowing from a portion of the electrode, the portion protruding outward of the steel strip. Accordingly, there arise problems such as the deepening of and the widening of a groove at the edge of the steel strip and the impossibility of obtaining a widthwise uniform shape of the groove.

An object of the present invention is to provide a method for continuous electrolytic etching of a grain oriented electrical steel strip and an apparatus for continuous electrolytic etching of a grain oriented electrical steel strip, which can restrain variations in the shapes of etched grooves along a width direction of a steel strip.

Solution to Problem

A method for continuous electrolytic etching of a grain oriented electrical steel strip according to the present invention includes a mask formation step of forming an etch mask on a surface of a grain oriented electrical steel strip cold-rolled to final thickness with a linear exposed portion exposed from the etch mask; a centering step of centering the grain oriented electrical steel strip with a position sensor and a centering apparatus, which are placed immediately upstream of an electrolytic etching apparatus; and a groove formation step of performing an electrolytic etching process in which electrolytic etching is performed in the electrolytic etching apparatus to form a linear groove on the surface of the grain oriented electrical steel strip by passing electric current between a conductor roll and an electrode placed in an electrolytic bath while the grain oriented electrical steel strip is brought into contact with the conductor roll, the grain oriented electrical steel strip is immersed in the electrolytic bath and the grain oriented electrical steel strip is facing the electrode.

Moreover, in the above-described method for continuous electrolytic etching of a grain oriented electrical steel strip according to the present invention, the groove formation step includes performing the electrolytic etching process using the electrode whose width is within ±10 mm of a steel strip width of the arain oriented electrical steel strip.

Moreover, in the above-described method for continuous electrolytic etching of a grain oriented electrical steel strip according to the present invention, the groove formation step includes performing the electrolytic etching process using the electrode whose side surface in the width direction is covered with an insulating material.

An apparatus for continuous electrolytic etching of a grain oriented electrical steel strip according to the present invention includes a mask-forming apparatus configured to form an etch mask on a surface of a grain oriented electrical steel strip cold-rolled to final thickness with a linear exposed portion being exposed from the etch mask; an electrolytic etching apparatus including an electrolytic bath, an electrode placed in the electrolytic bath, and a conductor roll, the electrolytic etching apparatus performing an electrolytic etching process in which electrolytic etching is performed to form a linear groove on the surface of the grain oriented electrical steel strip by passing electric current between the conductor roll and the electrode while the grain oriented, electrical steel strip is brought into contact with the conductor roll, the grain oriented electrical steel strip is immersed in the electrolytic bath, and the grain oriented electrical steel strip is facing the electrode; a position sensor, placed immediately upstream of the electrolytic etching apparatus, to detect a position of the grain oriented electrical steel strip in a width direction; and a centering apparatus, placed immediately upstream of the electrolytic etching apparatus, to center the grain oriented electrical steel strip on the basis of a detection result of the position sensor.

Advantageous Effects of Invention

A method for continuous electrolytic etching of a grain oriented electrical steel strip and an apparatus for continuous electrolytic etching of a grain oriented electrical steel strip according to the present invention can suppress variations in the shapes of etched grooves in a width direction of a steel strip.

DESCRIPTION OF EMBODIMENTS

A method for continuous electrolytic etching of a grain oriented electrical steel strip and an apparatus for continuous electrolytic etching of a grain oriented electrical steel strip according to an embodiment of the present invention are described in detail hereinafter with reference to the drawings. The invention is not limited by the embodiment. Moreover, components in the following embodiment include those that are easily conceivable by a person skilled in the art, or substantially the same ones.

Embodiment

Figure 1:
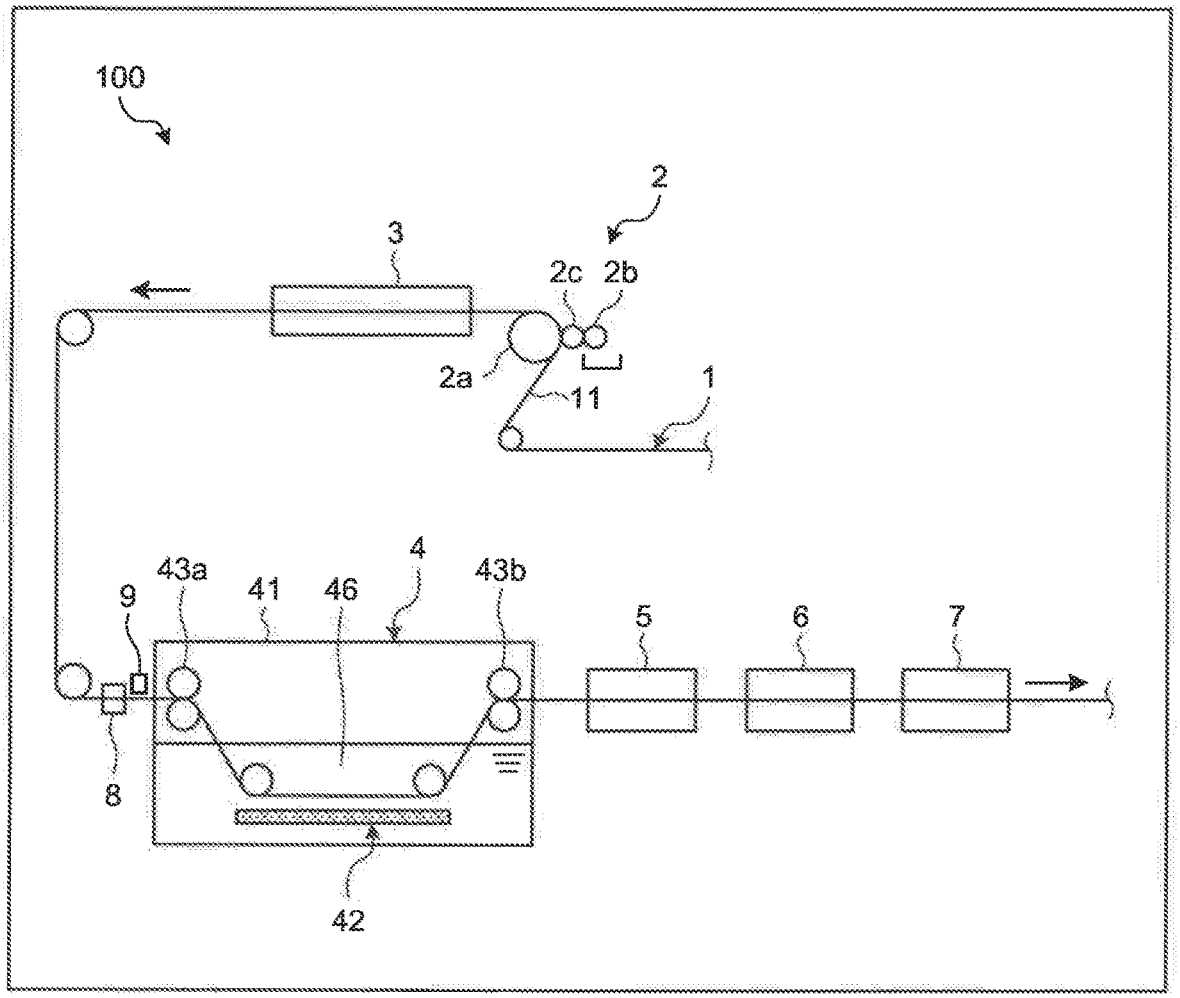
FIG. 1 is a schematic configuration diagram of an apparatus for continuous electrolytic etching of a grain oriented electrical steel strip according to an embodiment.

The embodiment is described with reference to FIGS. 1 to 5. The embodiment relates to a method for continuous electrolytic etching of a grain oriented electrical steel strip and an apparatus for continuous electrolytic etching of a grain oriented electrical steel strip. The method for continuous electrolytic etching of a grain oriented electrical steel strip of the embodiment forms linear grooves on a surface of a grain oriented electrical steel strip cold-rolled to final thickness by, for example, selectively forming an etch mask on the surface of the grain oriented electrical steel strip, continuously loading the grain oriented electrical steel strip into an electrolytic cell, and performing an electrolytic etching process thereon. FIG. 1 is a schematic configuration diagram of the apparatus for continuous electrolytic etching of a grain oriented electrical steel strip according to the embodiment of the present invention.

As illustrated in FIG. 1, an apparatus 100 for continuous electrolytic etching of a grain oriented electrical steel strip according to the embodiment (hereinafter also simply referred to as the "continuous electrolytic etching apparatus") includes an etch-resist-coating apparatus 2, a drying-and-baking apparatus 3, an electrolytic etching apparatus 4, an etch-resist-removing apparatus 5, a water rinse tank 6, a rinse tank r, a centering apparatus 8, and a position sensor 9. Moreover, the method for continuous electrolytic etching of the embodiment, which is implemented by the continuous electrolytic etching apparatus 100, includes a mask formation step, a centering step, and a groove formation step.

(Mask Formation Step)

Figure 2:
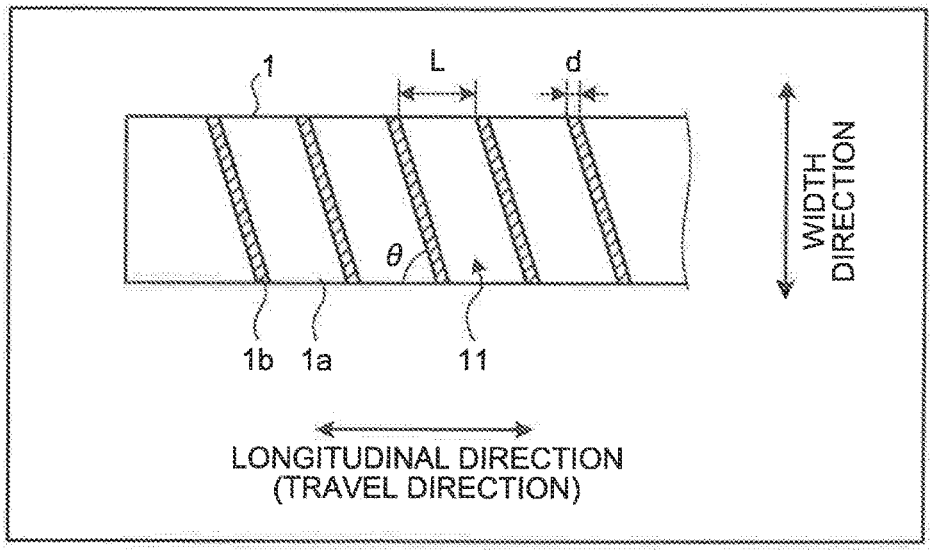
FIG. 2 is a plan view illustrating an example of an etch mask.

The mask formation step is the step of forming an etch mask 1*a* on a surface 11 of a grain oriented electrical steel strip 1 cold-rolled to final thickness with linear exposed portions 1*b* being exposed from the etch mask 1*a* (refer to FIG. 2). The continuous electrolytic etching apparatus 100 includes the etch-resist-coating apparatus 2 and the drying-and-baking apparatus 3 as a mask-forming apparatus. The etch-resist-coating apparatus 2 and the drying-and-baking apparatus 3 execute the mask formation step. The continuous electrolytic etching apparatus 100 coats, with an etch resist, the surface 11 of the grain oriented electrical steel strip 1 cold-rolled to final thickness, dries and bakes the grain oriented electrical steel strip 1, and selectively forms the etch mask 1*a*.

(Centering Step)

The centering step is the step of centering the grain oriented electrical steel strip 1 with the position sensor 9 and the centering apparatus 8, which are placed immediately upstream of the electrolytic etching apparatus 4. The centering step restrains a displacement of the grain oriented electrical steel strip 1 from a line center. Consequently, variations in current densities in the electrolytic etching process are restrained; accordingly, linear grooves of a uniform shape are formed.

(Groove Formation Step)

The groove formation step is the step of performing the electrolytic etching process in which electrolytic etching is performed in the electrolytic etching apparatus 4 to form the linear grooves on the surface 11 of the grain oriented electrical steel strip 1 by passing electric current between conductor rolls 43*a* and 43*b* and an electrode 42 placed in an electrolytic bath 46 while the grain oriented electrical steel strip 1 is brought into contact with the conductor rolls 43*a* and 43*b*, the grain oriented electrical steel strip 1 is immersed in the electrolytic bath 46 and the grain oriented electrical steel strip 1 is facing the electrode 42.

The etch mask 1*a* is removed by the etch-resist-removing apparatus 5 from the surface 11 of the grain oriented electrical steel strip 1 on which the linear grooves have been introduced. The grain oriented electrical steel strip 1 is then cleaned in the water rinse tank 6 and the rinse tank 7. The method for continuous electrolytic etching of a grain oriented electrical steel strip and the apparatus 100 for continuous electrolytic etching of a grain oriented electrical steel strip of the embodiment are described in detail below.

The grain oriented electrical steel strip 1 cold-rolled to the final thickness is carried by transport devices such as transport rolls sequentially to the etch-resist-coating apparatus 2, the drying-and-baking apparatus 3, the electrolytic etching apparatus 4, the etch-resist removing apparatus 5, the water rinse tank 6, and the rinse tank 7 in this order. The etch-resist-coating apparatus 2 coats the surface 11 of the grain oriented electrical steel strip 1 with an etch resist. The etch-resist-coating apparatus 2 of the embodiment coats the surface 11 of the grain oriented electrical steel strip 1, except the linear exposed portions 1*b*, with the etch resist by gravure offset printing.

FIG. 2 illustrates an example of the etch mask formed on the grain oriented electrical steel strip 1. The etch mask 1*a* is formed in a band shape on the surface 11 of the grain oriented electrical steel strip 1, except the linear exposed portions 1*b*. The exposed portion 1*b* is inclined at, for example, a predetermined inclination angle θ with respect to a longitudinal direction (travel direction) of the grain oriented electrical steel strip 1. The width of the exposed portion 1*b* in the travel direction is denoted by d, and the width of the etch mask 1*a* in the travel direction is denoted by L.

Returning to FIG. 1, the etch-resist-coating apparatus 2 includes a backup roll 2*a*, a gravure roll 2*b*, and a rubber transfer roll 2*c*. The rubber transfer roll 2*c* is placed between the gravure roll 2*h* and the backup roll 2*a* and is in contact with both the rolls 2*a* and 2*b*. Recesses that match the shape of the etch mask 1*a* formed on the grain oriented electrical steel strip 1 are formed in the gravure roll 2*b*. Ink of the etch resist accumulated in the recess is transferred onto the surface 11 of the grain oriented electrical steel strip 1 via the rubber transfer roll 2*c*. The rubber transfer roll 2*c* sandwiches the grain oriented electrical steel strip 1 with the backup roll 2*a*, and coats the grain oriented electrical steel strip 1 with the ink while applying pressure to the grain oriented electrical steel strip 1. A resist ink having any of alkyd-based resin, epoxy-based resin, and polyethylene-based resin as a main ingredient is suitable for the ink to be used as the etch resist.

The drying-and-baking apparatus 3 dries and bakes the etch resist ink applied to the surface 11 of the grain oriented electrical steel strip 1. Consequently, the etch mask 1*a* is formed on the surface 11 of the grain oriented electrical steel strip 1, with the linear exposed portions 1*b* being exposed from the etch mask 1*a*.

Figure 3:
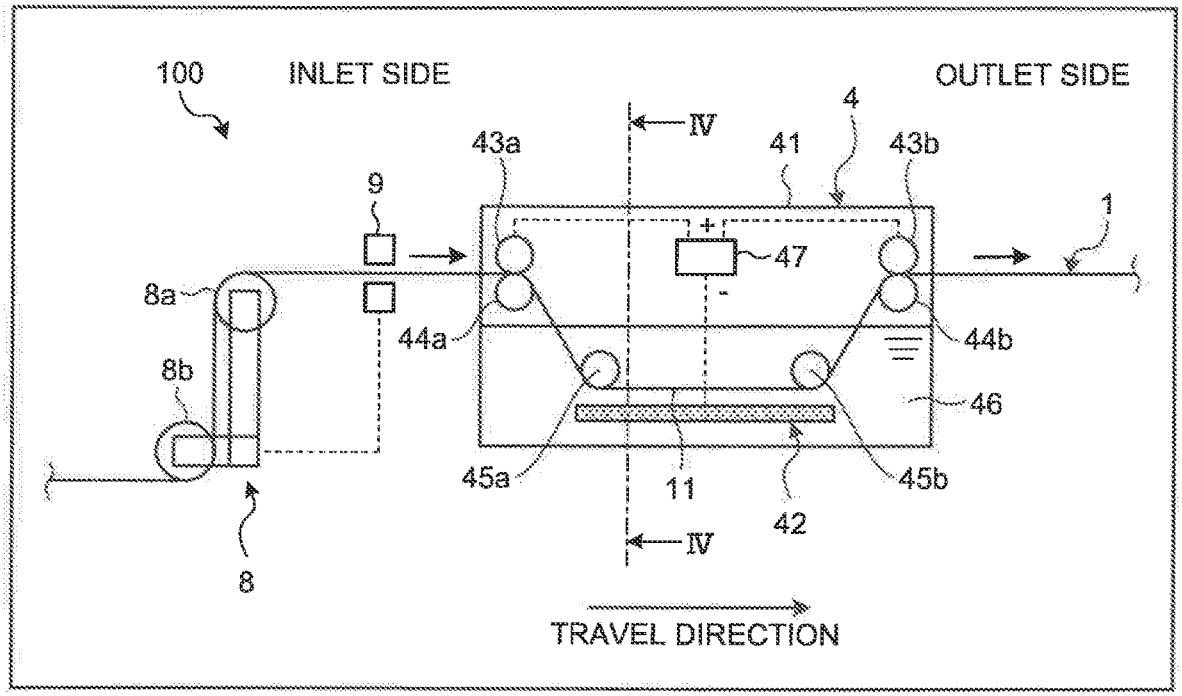
FIG. 3 is a diagram illustrating main parts of the apparatus for continuous electrolytic etching of a grain oriented electrical steel strip according to the embodiment.

As illustrated in FIG. 3, the position sensor 9 and the centering apparatus 8 are placed immediately upstream of the electrolytic etching apparatus 4. In other words, the position sensor 9 and the centering apparatus 8 are placed on an inlet side of and in the vicinity of the electrolytic etching apparatus 4. The centering apparatus 8 is placed upstream of the position sensor 9 in the travel direction of the grain oriented electrical steel strip 1. The position sensor 9 detects the position of the grain oriented electrical steel strip 1 in the width direction. The position sensor 9 typically detects the positions of both end faces (edges) of the grain oriented electrical steel strip 1 in the width direction to detect the widthwise center position of the grain oriented electrical steel strip 1. The position in the width direction detected by the position sensor 9 is transmitted to the centering apparatus 8. The centering apparatus 8 centers the grain oriented electrical steel strip 1 on the basis of the detection result of the position sensor 9. The centering apparatus 8 typically adjusts the widthwise center position of the grain oriented electrical steel strip 1 on the basis of the position in the width direction acquired from the position sensor 9 so as to avoid a displacement from a predetermined line center. The centering apparatus 8 adjusts the position of the grain oriented electrical steel strip 1 in the width direction by, for example, inclining the rotation axis of an upstream roller 8*b* with respect to the rotation axis of a downstream roller 8*a*.

The electrolytic etching apparatus 4 includes an electrolytic etching cell 41, the electrode 42, the conductor rolls 43*a* and 43*b*, backup rolls 44*a* and 44*b*, sink rolls 45*a* and 45*b*, the electrolytic bath 46, and a power supply 47. The electrolytic etching apparatus 4 immerses a part of the grain oriented electrical steel strip 1 in the electrolytic bath 46 by the sink rolls 45*a* and 45*b* in a state where the conductor rolls 43*a* and 43*b* are in contact with the grain oriented electrical steel strip 1 and makes the grain oriented electrical steel strip 1 face the electrode 42 between the sink rolls 45*a* and 45*b*. The electrolytic etching apparatus 4 passes electric current between the conductor rolls 43*a* and 43*b* and the electrode 42 and forms the linear grooves by the electrolytic etching process in the surface 11 of the grain oriented electrical steel strip 1.

The electrolytic bath 46 is stored in the electrolytic etching cell 41. The electrolytic bath 46 is an electrolyte such as a NaCl solution or KCl solution. The electrode 42 is placed in the electrolytic bath 46. The conductor rolls 43*a* and 43*b* and the backup rolls 44*a* and 44*b* are placed above a liquid level of the electrolytic bath 46 in the electrolytic etching cell 41. The inlet-side conductor roll 43*a* and the inlet-side backup roll 44*a* are placed on an inlet side in the electrolytic etching cell 41. The outlet-side conductor roll 43*b* and the outlet-side backup roll 44*b* are placed on an cutlet side in the electrolytic etching cell 41. The conductor rolls 43*a* and 43*b* are anodes that come into contact with the grain oriented electrical steel strip 1. The grain oriented electrical steel strip 1 is sandwiched between the inlet-side conductor roll 43*a* and the inlet-side backup roll 44*a* to maintain the state where the grain oriented electrical steel strip 1 and the inlet-side conductor roll 43*a* are in contact with each other. Moreover, the grain oriented electrical steel strip 1 is sandwiched between the outlet-side conductor roll 43*b* and the outlet-side backup roll 44*b* to maintain the contact state of the grain oriented electrical steel strip 1 and the outlet-side conductor roll 43*b*.

The sink rolls 45*a* and 451 are immersed in the electrolytic bath 46 to immerse the grain oriented electrical steel strip 1 in the electrolytic bath 46. In the electrolytic etching cell 41, the inlet-side sink roll 45*a* is placed on the inlet side and the outlet-side sink roll 45*b* on the outlet side. The grain oriented electrical steel strip 1 is carried in the electrolytic etching cell 41 in a state of being wound around the inlet-side backup roll 44*a*, the inlet-side sink roll 45*a*, the outlet-side sink roll 45*b*, and the outlet backup roll 44*b*. The grain oriented electrical steel strip 1 to be carried enters the electrolytic bath 46 between the inlet-side backup roll 44*a* and the inlet-side sink roll 45*a*, passes below the sink rolls 45*a* and 45*b*, and goes out of the electrolytic bath 46 between the outlet-side sink roll 45*b* and the outlet-side backup roll 44*b*.

The electrode 42 is a cathode paired with the conductor rolls 43*a* and 43*b*. The electrode 42 is connected to a cathode side of the power supply 47, and the conductor rolls 43*a* and 43*b* are connected to an anode side of the power supply 47. In the electrolytic etching apparatus 4, a current circuit is configured including the power supply 47, the conductor roll 43*a*, 43*b*, the grain oriented electrical steel strip 1, the electrolytic bath 46, and the electrode 42. The current density in the electrolytic etching process is preferably in a range of 1 to 100 [A/dm$^2$]. If the current density is too low, a sufficient etching effect cannot be obtained. Moreover, if the current density is too high, the etch mask 1*a* is damaged.

As illustrated in FIG. 3, the flat plate-shaped electrode 42 is placed at a position facing the surface 11 of the grain oriented electrical steel strip 1 in the electrolytic bath 46. More specifically, the electrode 42 is placed below the grain oriented electrical steel strip 1 in the electrolytic bath 46, and faces an area of the surface 11 of the grain oriented electrical steel strip between the inlet-side sink roll 45*a* and the outlet-side sink roll 45*b*.

Figure 4:
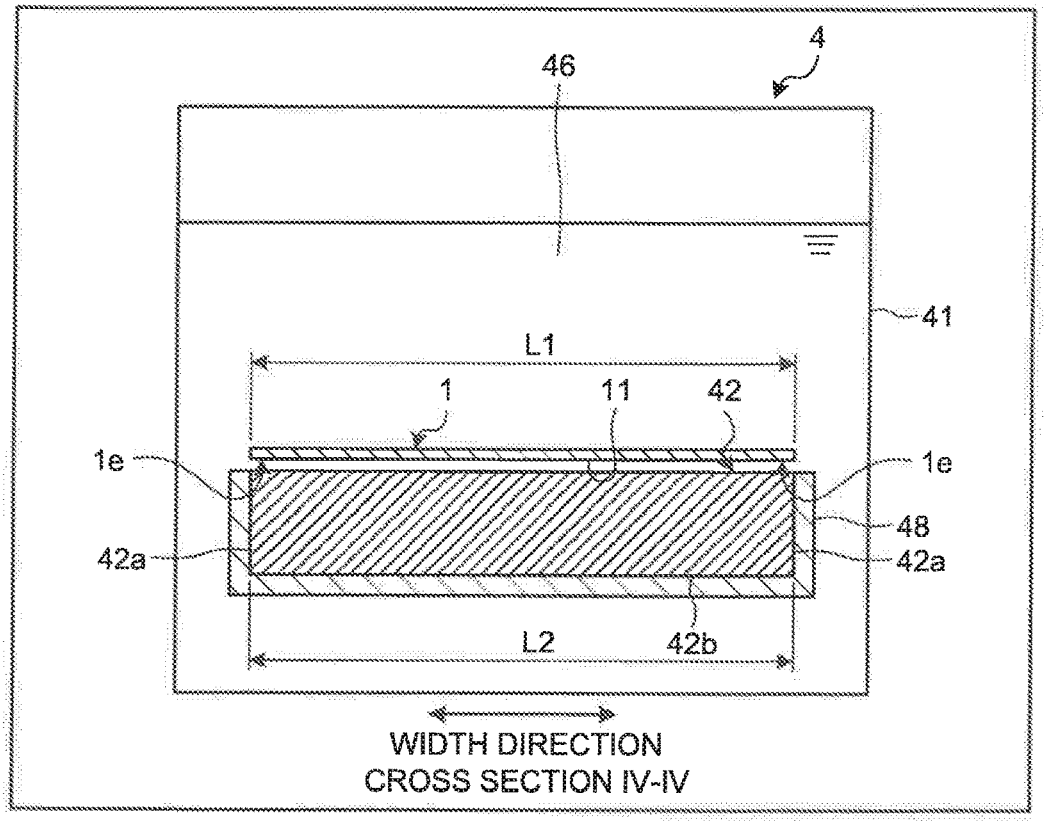
FIG. 4 is a cross-sectional view of an electrolytic etching apparatus according to the embodiment.
Figure 5:
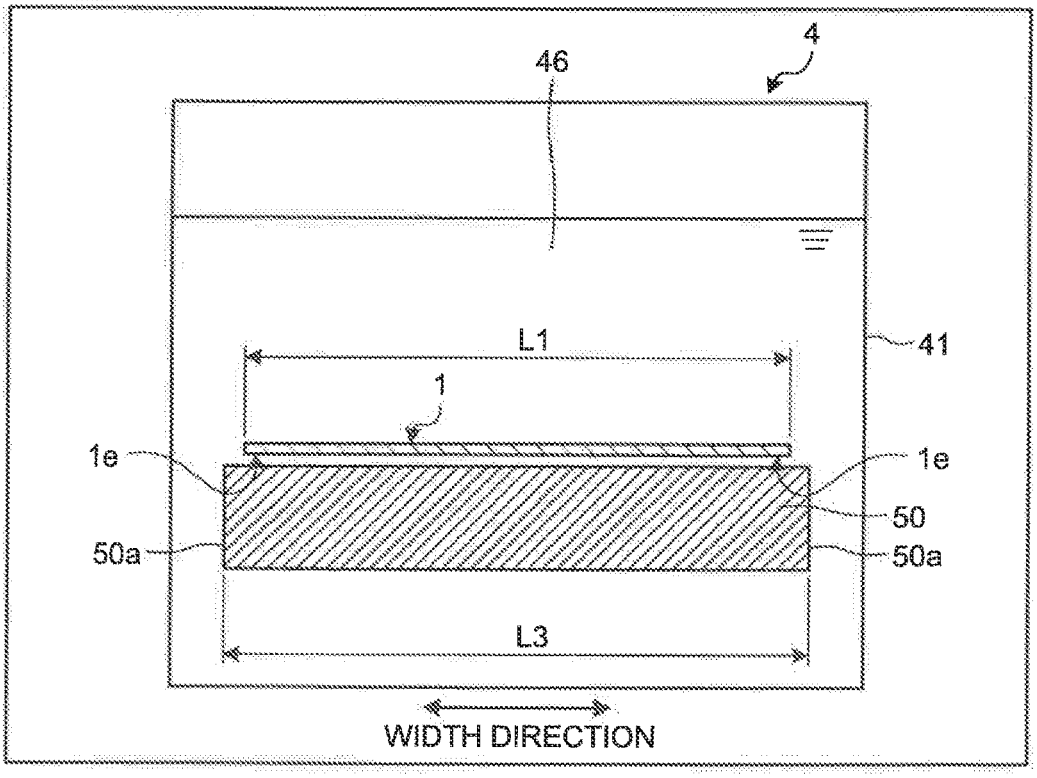
FIG. 5 is a cross-sectional view of an electrolytic etching apparatus according to a comparative example.

FIG. 4 illustrates a cross section IV-IV of FIG. 3. The electrode 42 is placed such that the line center agrees with the widthwise center line of the electrode 42. As illustrated in FIG. 4, a width L1 of the grain oriented electrical steel strip 1 is equal or substantially equal to a width L2 of the electrode 42. Consequently, unnecessary electrolysis near ends 1*e* of the grain oriented electrical steel strip 1 in the width direction can be restrained. The width L2 of the electrode 42 is preferably the width L1 of the grain oriented electrical steel strip 1±10 [mm]. In the embodiment, the width L2 of the electrode 42 is equal to the width L1 of the grain oriented electrical steel strip 1. If a width L3 of an electrode 50 is larger by a given length than the width L1 of the grain oriented electrical steel strip 1 as in a comparative example of FIG. 5, parts that are not targeted for electrolysis, that is, parts other than the exposed portions 1*b*, are electroetched at the ends 1*e* of the grain oriented electrical steel strip in the width direction. Moreover, ends of the exposed portion 1*b* in the width direction are excessively electroetched compared with its center. In contrast, in the electrolytic etching apparatus 4 of the embodiment, the electrolytic etching process is restrained from being unnecessarily performed or being excessively performed at the ends 1*e* in the width direction since the width L2 of the electrode 42 is similar to the width L1 of the grain oriented electrical steel strip 1.

Moreover, in the electrolytic etching apparatus 4 of the embodiment, side surfaces 42*a* of the electrode 42 in the width direction are covered with an insulating material 48 as illustrated in FIG. 4. In the comparative example illustrated in FIG. 5, side surfaces 50*a* of the electrode 50 are in contact with the electrolytic bath 46. Accordingly, the current flows from the grain oriented electrical steel strip 1 to the side surfaces 50*a* of the electrode 50. Consequently, the value of the current (current density) flowing through the end 1*e* of the grain oriented electrical steel strip 1 in the width direction becomes larger than the value of the current (current density) flowing through the center in the width direction; accordingly, the end in the width direction is overetched. On the other hand, in the electrolytic etching apparatus 4 of the embodiment, the insulating material 48 restricts the flow of the current from the grain oriented electrical steel strip 1 to the side surface 42*a* of the electrode 42. Consequently, the end 1*e* of the grain oriented electrical steel strip 1 in the width direction is restrained from being excessively electroetched. In the embodiment, a back surface 42*b* of the electrode 42 is also covered with the insulating material 48. Consequently, the current is restrained from flowing from the grain oriented electrical steel strip 1 to the back surface 42*b* of the electrode 42.

Examples

Examples are described. Table 1 illustrates test conditions and results of first to sixth examples and the comparative example. In the examples and the comparative example, the grain oriented electrical steel strip 1 is a steel strip with a thickness of 0.22 [mm] containing Si: 3.0 [mass %]. A steel strip width L1 after the final cold rolling is 1,000 [mm]. A resist ink containing epoxy-based resin as a main ingredient was used as the etch resist. The drying and baking temperature are 100 [° C.]. The thickness of an etch mask is 3 [μm].

After the etch-resist-coating apparatus 2 and the drying-and-baking apparatus 3 form the etch mask 1*a* on the surface 11 of the grain oriented electrical steel strip 1, the electrolytic etching apparatus 4 performs an electrolytic etching process on the grain oriented electrical steel strip 1 by direct electrification. The electrolytic bath 46 is a NaCl solution. Target values of a groove shape of the linear groove are the width: 150 [μm], the depth: 20 [μm], and the groove interval: 3 [mm].

After the electrolytic etching process is performed, the grain oriented electrical steel strip 1 passes through the etch-resist-removing apparatus 5, the water rinse tank 6, and the rinse tank 7 to remove the etch mask 1*a* from the surface 11. The groove depth of the linear groove was measured after the etch mask 1*a* was removed. Ten points to measure the groove depth are set at regular intervals from one end to the other end along the width direction of the grain oriented electrical steel strip 1. The average and variation of the groove depths were calculated from the measurement values of the 10 points.

The grain oriented electrical steel strip 1 from which the etch mask 1*a* is removed is decarburized and annealed. Final annealing is subsequently performed on the grain oriented electrical steel strip 1. A magnetic property (iron loss $W_{17/50}$ [W/kg]) of the grain oriented electrical steel strip 1 obtained in this manner was measured. 10 points to measure the magnetic property are set at regular intervals from one end to the other end along the width direction of the grain oriented electrical steel strip 1. The average and variation of the iron loss $W_{17/50}$ were calculated from the measurement values of the 10 points.

In all the first to sixth examples, centering control is performed by the centering apparatus 8. The examples are different in the size of the width L2 of the electrode 42 and the presence or absence of the insulating material 48 covering the side surfaces 42*a* of the electrode 42 in the width direction. As illustrated in table 1, the first example is as follows: centering control: done, the width L2 of the electrode 42: 1,010 [mm] (the width L1 of the grain oriented electrical steel strip 1+10 [mm]), and the insulating material 48: absent. The second example is different from the first example in that the width L2 of the electrode 42 is 1,000 [mm]. The example 3 is different from the first example in that the width L2 of the electrode 42 is 990 [mm] (the width L1 of the grain oriented electrical steel strip 1−10 [mm]). The fourth example is different from the first example in that the insulating material 48 is present. The fifth example is different from the first example in the respects that the width L2 of the electrode 42 is 1,000 [mm], and the insulating material 48 is present. The sixth example is different from the first example in the respects that the width L2 of the electrode 42 is 990 [mm], and the insulating material 48 is present. The comparative example is as follows: centering control: not done, the width L2 of the electrode 42: 1,010 [mm], and the insulating material 48: absent.

As illustrated in table 1, the average groove depth deviates by 0.14 [μm] from a target value (20 [μm]) in the comparative example. In contrast, in the first to sixth examples, a deviation of the average from the target value of the groove depth is 0.04 [μm] at the maximum. Moreover, the distribution width of the groove depth is ±0.5 [μm] in the comparative example while the distribution width of the groove depth is reduced to ±0.09 [μm] at the maximum in the examples.

See the iron loss $W_{17/50}$. The average is 0.752 [W/kg] in the comparative example while the averages are 0.720 to 0.731 [W/kg] in the examples, which are good. Moreover, the variation in the iron loss $W_{17/50}$ is ±0.020 [w/kg] in the comparative example while the maximum variation is ±0.009 [W/kg] in the examples, which is less than half the variation of the comparative example. Among the examples, the fifth example is the best in the accuracy of the groove depth and the value of the iron loss $W_{17/50}$. In other words, variations in the shapes of the etched grooves along the width direction of the grain oriented electrical steel strip 1 are effectively restrained by the multiplier effect due to the agreement of the width L2 of the electrode 42 with the width L1 of the grain oriented electrical steel strip 1, and the side surfaces 42*a* of the electrode 42 covered with the insulating material 48 in addition to the centering control effect. Moreover, an good value of the iron loss $W_{17/50}$ is obtained accordingly.

TABLE 1

| | Centering control | Electrode width (mm) | Insulating material on side surfaces of electrode | Groove depth (μm) | Iron loss $W_{17/50}$ (W/kg) Average | Variation |
|---|---|---|---|---|---|---|
| First example | Done | 1010 | Absent | 20.04 ± 0.08 | 0.730 | ±0.008 |
| Second example | Done | 1000 | Absent | 20.02 ± 0.06 | 0.728 | ±0.006 |
| Third Example | Done | 990 | Absent | 19.96 ± 0.09 | 0.731 | ±0.009 |
| Fourth example | Done | 1010 | Present | 19.98 ± 0.05 | 0.725 | ±0.005 |
| Fifth example | Done | 1000 | Present | 20.00 ± 0.03 | 0.720 | ±0.003 |
| Sixth example | Done | 990 | Present | 20.01 ± 0.04 | 0.724 | ±0.004 |
| Comparative example | Not done | 1010 | Absent | 19.86 ± 0.50 | 0.752 | ±0.020 |

As described above, the method for continuous electrolytic etching of a grain oriented electrical steel strip of the embodiment includes the mask formation step, the centering step, and the groove formation step. In the centering step, the position sensor 9 and the centering apparatus 8, which are placed immediately upstream of the electrolytic etching apparatus 4, center the grain oriented electrical steel strip 1 to restrain the center line of the grain oriented electrical steel strip 1 from deviating in the width direction from the center line of the electrode 42. Consequently, the imbalance of the current density in the width direction of the grain oriented electrical steel strip 1 is restrained from occurring. Hence, the method for continuous electrolytic etching of a grain oriented electrical steel strip of the embodiment can restrain variations in the shapes of the etched grooves along the width direction of the grain oriented electrical steel strip 1.

The method for continuous electrolytic etching of a grain oriented electrical steel strip of the embodiment can provide a uniform shape of an etched groove in the width direction of the grain oriented electrical steel strip 1. Moreover, the current that does not contribute to the electrolytic etching process and the needless current for an unnecessary electrolytic etching process can be reduced; accordingly, the electrolysis efficiency can be increased. Moreover, interference caused by the meander in the electrolytic etching apparatus 4 can be prevented. The production occasion loss and the production yield loss due to a damage to an edge of the grain oriented electrical steel strip 1 can be reduced.

Moreover, the method for continuous electrolytic etching of a grain oriented electrical steel strip of the embodiment performs the electrolytic etching process in the groove formation step, using the electrode 42 whose width L2 is within ±10 mm of the width L1 of the grain oriented electrical steel strip 1. Consequently, the current density at the end of the grain oriented electrical steel strip 1 in the width direction is restrained from being different from the current density at the center. Hence, variations in the shapes of the etched grooves along the width direction of the grain oriented electrical steel strip 1 are restrained.

Moreover, the method for continuous electrolytic etching of a grain oriented electrical steel strip of the embodiment performs the electrolytic etching process in the groove formation step, using the electrode 42 whose side surfaces 42*a* in the width direction are covered with the insulating material 48. Consequently, the current is restricted in flowing between the grain oriented electrical steel strip 1 and the side surface 42*a* of the electrode 42. The current density at the end of the grain oriented electrical steel strip 1 in the width direction is restrained from becoming larger than the current density at the center. Hence, variations in the shapes of the etched grooves along the width direction of the grain oriented electrical steel strip 1 are restrained.

The apparatus 100 for continuous electrolytic etching of a grain oriented electrical steel strip of the embodiment includes the mask-forming apparatus (the etch-resist-coating apparatus 2 and the drying-and-baking apparatus 3), the electrolytic etching apparatus 4, the position sensor 9, and the centering apparatus 8. The centering apparatus 8 centers the grain oriented electrical steel strip 1 on the basis of a detection result of the position sensor 9. Accordingly, the center line of the grain oriented electrical steel strip 1 is restrained from deviating in the width direction from the center line of the electrode 42. Consequently, the imbalance of the current density in the width direction of the grain oriented electrical steel strip 1 is restrained from occurring. Hence, the apparatus 100 for continuous electrolytic etching of a grain oriented electrical steel strip of the embodiment can restrain variations in the shapes of the etched grooves along the width direction of the grain oriented electrical steel strip 1.

The etch-resist-coating apparatus 2, which coats the grain oriented electrical steel strip 1 with an etch resist, is not limited to the apparatus described above. The etch-resist-coating apparatus 2 can suitably use any method of gravure printing without an offset roll, flat offset printing, screen printing, and the like. Gravure offset printing is suitable since, for example, continuous printing for a coil is easily performed, a stable print surface can be obtained, and control over the thickness of a resist is easy.

The contents described in the above embodiments can be implemented in combination as appropriate.

INDUSTRIAL APPLICABILITY

The present invention can provide a method for continuous electrolytic etching of a grain oriented electrical steel strip and an apparatus for continuous electrolytic etching of a grain oriented electrical steel strip, which can restrain variations in the shapes of etched grooves along a width direction of a steel strip.

REFERENCE SIGNS LIST

1 grain oriented electrical steel strip
1*a* etch mask
1*b* exposed portion
11 surface
2 etch-resist-coating apparatus
2*a* backup roll
2*b* gravure roll
2*c* rubber transfer roll

3 drying and baking apparatus
4 electrolytic etching apparatus
41 electrolytic etching cell
42, 50 electrode
43*a* inlet-side conductor roll
43*b* outlet-side conductor roll
44*a* inlet-side backup roll
44*b* outlet-side backup roll
45*a* inlet-side sink roll
45*b* outlet-side sink roll
46 electrolytic bath
47 power supply
48 insulating material
5 etch-resist-removing apparatus
6 water rinse tank
7 rinse tank
8 centering apparatus
9 position sensor
100 apparatus for continuous electrolytic etching of grain oriented electrical steel strip

The invention claimed is:

1. A method for continuous electrolytic etching of a grain oriented electrical steel strip, the method comprising:

forming an etch mask on a surface of a grain oriented electrical steel strip cold-rolled to a final thickness with a linear exposed portion that is exposed from the etch mask;

centering the grain oriented electrical steel strip with a position sensor and a centering apparatus, which are placed immediately upstream of an electrolytic etching apparatus; and performing an electrolytic etching process in the electrolytic etching apparatus to form a linear groove on the surface of the grain oriented electrical steel strip by passing an electric current between a conductor roll and an electrode placed in an electrolytic bath while the grain oriented electrical steel strip: is brought into contact with the conductor roll, is immersed in the electrolytic bath, and faces the electrode, wherein a side surface of the electrode in a width direction and a back surface of the electrode are covered with an insulating material, the back surface opposes a surface of the electrode facing the grain oriented electrical steel strip.

2. The method for continuous electrolytic etching of a grain oriented electrical steel strip according to claim 1, wherein the electrode has a width that is within ±10 mm of a steel strip width of the grain oriented electrical steel strip.

3. An apparatus for continuous electrolytic etching of a grain oriented electrical steel strip, the apparatus comprising:

a mask-forming apparatus configured to form an etch mask on a surface of a grain oriented electrical steel strip cold-rolled to a final thickness with a linear exposed portion being exposed from the etch mask;

an electrolytic etching apparatus including an electrolytic bath, an electrode placed in the electrolytic bath, and a conductor roll, the electrolytic etching apparatus being configured to perform an electrolytic etching process to form a linear groove on the surface of the grain oriented electrical steel strip by passing electric current between the conductor roll and the electrode while the grain oriented electrical steel strip: is brought into contact with the conductor roll, is immersed in the electrolytic bath, and faces the electrode, a side surface of the electrode in a width direction and a back surface of the electrode being covered with an insulating material, the back surface opposing a surface of the electrode facing the grain oriented electrical steel strip;

a position sensor, placed immediately upstream of the electrolytic etching apparatus, and configured to detect a position of the grain oriented electrical steel strip in a width direction; and a centering apparatus, placed immediately upstream of the electrolytic etching apparatus, and configured to center the grain oriented electrical steel strip based on a detection result from the position sensor.

* * * * *